US006866590B2

(12) United States Patent
Tucker

(10) Patent No.: US 6,866,590 B2
(45) Date of Patent: Mar. 15, 2005

(54) SELF-AIMING BILLIARD BALLS AND METHOD OF USING SAME

(76) Inventor: Joseph Tucker, 62B Fiume St., West Warwick, RI (US) 02893

( * ) Notice: Subject to any disclaimer, the term of this patent is extended or adjusted under 35 U.S.C. 154(b) by 10 days.

(21) Appl. No.: 10/250,160

(22) Filed: Jun. 9, 2003

(65) Prior Publication Data

US 2003/0236126 A1 Dec. 25, 2003

Related U.S. Application Data

(60) Provisional application No. 60/390,944, filed on Jun. 24, 2002.

(51) Int. Cl.[7] ..... A63D 15/00
(52) U.S. Cl. ..... 473/2; 473/52
(58) Field of Search ..... 473/1, 2, 52, 23, 473/125, 378, 365; 40/327; D21/713; 273/118 R, 123 R, 126 R

(56) References Cited

U.S. PATENT DOCUMENTS

| | | | | | |
|---|---|---|---|---|---|
| 280,807 | A | * | 7/1883 | Farely | 473/410 |
| 676,506 | A | * | 6/1901 | Knight et al. | 473/268 |
| 3,318,598 | A | * | 5/1967 | Ruskin | 473/55 |
| 3,711,091 | A | * | 1/1973 | Dixon | 473/2 |
| 3,947,026 | A | * | 3/1976 | Scoutten | 473/2 |
| 3,993,305 | A | * | 11/1976 | Nicholson | 473/2 |
| 5,190,294 | A | * | 3/1993 | Oka | 473/383 |
| 5,322,475 | A | * | 6/1994 | Irvin | 473/52 |
| 5,401,215 | A | | 3/1995 | Pfost | |
| 5,716,283 | A | | 2/1998 | Simpson et al. | |
| D393,672 | S | * | 4/1998 | Clay | D21/713 |
| 6,364,783 | B1 | | 4/2002 | Kellogg, Jr. et al. | |
| 6,527,647 | B2 | * | 3/2003 | Ringeisen | 473/2 |
| 6,761,643 | B2 | * | 7/2004 | Boatwright | 473/2 |

FOREIGN PATENT DOCUMENTS

| | | | | |
|---|---|---|---|---|
| GB | 1548354 A | * | 7/1979 | A63D/15/00 |
| GB | 2145630 A | * | 4/1985 | A63B/37/14 |
| GB | 2190301 A | * | 11/1987 | A63B/45/02 |
| GB | 2250202 A | * | 6/1992 | A63B/37/14 |
| GB | 2259257 A | * | 3/1993 | A63B/37/14 |

* cited by examiner

*Primary Examiner*—Mitra Aryanpour
(74) *Attorney, Agent, or Firm*—Barlow, Josephs & Holmes, Ltd.

(57) ABSTRACT

A combination of a cue ball and an object ball is used for aiming a cue ball to impact an object ball for motion of the object ball in a desired direction. The object ball has a series of object indicia on the outer surface that includes a center indicia and a number of auxiliary indicia on opposing sides thereof. The cue ball has a series of cue indicia on the outer surface that includes a center indicia and a number of auxiliary indicia on opposing sides thereof where the cue indicia is substantially identical to the object indicia. The object ball is aligned with its indicia parallel to a rail of the billiard table. The cue ball is aligned with its indicia parallel to the rail and facing the object indicia. An aiming line is extended through the object ball and through the object indicia to identify an object ball target indicia. Corresponding cue indicia is selected to identify a cue ball impact indicia. The cue ball is impacted into the object ball so that the object ball target indicia contacts the cue ball impact indicia thereby directing the object ball along the aiming line.

8 Claims, 12 Drawing Sheets

SELF-AIMING BILLIARD BALLS AND METHOD OF USING SAME

CROSS REFERENCE TO RELATED APPLICATIONS

This application claims the benefit of U.S. Provisional Application 60/390,944 having a filing date of Jun. 24, 2002, the contents of which are incorporated by reference.

BACKGROUND OF INVENTION

The present invention relates to table games, such as pocket billiards, traditional billiards and snooker. More specifically, the present invention relates to training balls and a method of using them for the purposes of improving a player's aim in these table games to cause an object ball to roll in the desired direction after being struck by a cue ball.

Various well known table games exist where a cue stick is used to strike a cue ball to make it impact into an object bail to make that object ball travel in a desired direction. For example, in the game of pocket billiards, a cue ball is commonly struck into an object ball to sink it into a desired corner or side pocket. In billiards, an impact ball is struck into an object ball for the purposes of contact other object balls and rails.

For ease of discussion herein, the game of pocket billiards will be addressed in detail. However, it should be understood that the present invention can be employed in any table game where one ball is struck by a cue stick into another ball for the purposes of directing that ball in a desired direction. Therefore, the other types of table games will not be discussed herein as they employ and take advantage of the device and method of the present invention in similar fashion as the game of billiards.

In pocket billiards, various games are played using a cue ball and a series of consecutively numbered object balls. To start a game, the object balls are arranged in a formation at one end of a pocket billiard table with rails and are struck by a cue ball from the opposing end of the table. Arrangement of the formation of the object balls is facilitated by a rack. In a pocket billiard game of "Hi-Lo" or "straight pool", fifteen object balls are racked into a triangular-shaped formation. In the game of "nine ball", nine object balls are racked into a diamond-shaped formation. In these games, the cue ball is struck into the racked formation of object balls with the purpose of sinking the object balls, in an order dictated by the game being played, into the pockets.

During the game play of pocket billiards, the cue stick must first impact the cue ball before it hits an object ball. Thus, to sink an object ball into a pocket, it is possible that the cue ball may first be hit into a rail on the billiard table to then impact into an object ball to direct it into a pocket. However, the most common shot played on a pocket billiard table is where the cue ball is struck directly into an object ball for the purposes of directing that object in a desired direction. Frequently, that desired direction is directly into a pocket. That desired direction may also be into a rail or cushion for the purposes of making a bank shot. Moreover, the desired direction of the object ball may also be into another ball to make a combination shot.

In each of the foregoing shots where the cue ball impacts directly into an object ball, the cue ball must be carefully impacted into the object ball at the correct angle to ensure that the objected ball is propelled in the desired direction. For the purposes of this discussion, it is assumed that the speed of impact is sufficient to propel the object ball into the pocket. If the cue ball does not impact the object ball in the correct position, assuming the speed of impact is proper, the object ball will be off line and miss its target destination resulting in a missed shot.

Therefore, the game of pocket billiards continually requires that the player impact the object ball with the cue ball at the correct angle to avoid missed shots and improve the level of game play. To avoid misdirected object balls and misdirected shots, it is critical that two things occur. First, the player must determine what the correct angle of impact of the cue ball into the object is to make the desired shot. Then, the player must execute the shot by actually impacting the cue ball into the angle previously determined. If either one or both of these steps are carried out improperly, a missed shot will result.

More specifically, many amateur pocket billiard players misidentify the angle of impact the cue needs to make into the object ball. In other words, they perceive the angle of impact needed to direct the object ball in the desired direction as too great or too little. The selection of the correct impact angle is difficult for an amateur player to learn particularly because the cue ball and the object ball are both spherical in shape which makes it more difficult to read the angles needed to make a shot. Frequently, a player has determined the correct angle of impact to properly direct the object ball but they fail to execute the shot by impacting the cue ball properly into the object ball to cause it to be propelled in the correction direction.

The game of billiards focuses on the ability of the player to successfully determine the correct angle and then execute the shot. There have been many attempts in the prior art to improve a player's ability to carry out these steps. For example, there are prior billiard ball aiming systems where the outer surface of an object ball is covered with an array of colored dots where adjacent dots are of different colors from one another. In this system, the dots on the object ball are only used to assist the player in executing the shot, namely, hitting the selected portion of the object ball. These types of systems provide no assistance to the player in selecting and determining the correct aiming line and impact angle.

Also, various known aiming systems include the use of both a cue ball and an object ball. In these systems both the cue ball and the object ball have some type of indicia thereon. For example, known systems include a cue ball with a single band of material therearound and an object ball with two hemispheres of contrasting colors. The player manually determines the desired path of the object ball which is aligned with the meridian of the object ball being aligned with the desired path. The band of the cue ball is aligned with the path of the cue ball along the general direction of the object ball. The player hits the cue ball into the object ball at an angle that they have mentally determined and selected. The two-color hemispheres of the object visually assist the player to hit that angle that they have mentally selected. The indicia on the cue ball and the object ball assists the player to determining the rotation of the ball to see if the shot is not in the right direction and whether improper spin has been placed on either of the balls. However, these systems do not provide any guidance for the player to determine the proper angle of impact for an object ball.

Also, there have been prior art systems and methods that not only help determine the proper angle of impact of the cue ball into the object ball but also provide the proper contact points so the shot can be executed. For example, these known systems typically use intersecting bands of indicia on both the object ball and the cue all. The intersection of the vertical band and a horizontal band on the object ball determines the contact point of the object ball. The cue ball also has intersecting vertical and horizontal bands. The point of intersection determines the impact point of the cue ball into the object ball. The vertical band on the object ball is aligned with the desired path of the object ball, such as toward a pocket. The vertical band on the cue ball is aligned parallel to the direction of the vertical band of the object ball. Such aiming systems are difficult to successfully use because the player is required to align the vertical band of the cue ball parallel to an imaginary aiming line through the vertical band of the object ball. In accordance with this prior method and system, aligning the cue ball with its vertical band parallel to the aiming line through the vertical band of the object ball is very difficult to do for a player. This is exacerbated by the parallax effect, particularly when the balls are not close to one another on the table. This causes inaccurate alignment of the cue ball resulting in poor selection of the contact point on the cue ball.

In view of the foregoing, there is a demand for an aiming method and system that can selects the aiming line for the object ball as well as select the impact point on the cue ball. There is a demand for an aiming method and system that can more accurately and reliably select the aiming line and impact points than prior art methods and systems. There is a further demand for an aiming method and system that is easy to use. There is also a demand for an aiming method and system that greatly simplifies the number of shots that can be made on a billiard table. There is a demand for an aiming method and system that can be used with direct shots, bank shots and combination shots. There is a further need for an aiming method that can be used during actual game play even without the use of the physical training cue ball and object ball.

SUMMARY OF INVENTION

The present invention preserves the advantages of prior art training billiard balls, combination cue and object balls and methods for aiming and using the same. In addition, the device and method of the present invention provides new advantages not found in currently known billiard aiming systems and methods of using the same and overcomes many disadvantages of such currently available training systems and methods.

The present invention is generally directed to a device, system and method of aiming pocket billiard balls for training purposes. In accordance with the present invention, a combination of a cue ball and an object ball is used for aiming a cue ball to impact an object ball for motion of the object ball in a desired direction. The object ball has a series of object indicia on the outer surface that includes a center indicia and a number of auxiliary indicia on opposing sides thereof. The cue ball has a series of cue indicia on the outer surface that includes a center indicia and a number of auxiliary indicia on opposing sides thereof where the cue indicia is substantially identical to the object indicia. The object ball is aligned with its indicia parallel to a rail of the billiard table. The cue ball is aligned with its indicia parallel to the rail and facing the object indicia. An aiming line is extended through the object ball and through the object indicia to identify an object ball target indicia. Corresponding cue indicia is selected to identify a cue ball impact indicia. The cue ball is impacted into the object ball so that the object ball target indicia contacts the cue ball impact indicia thereby directing the object ball along the aiming line.

In operation, the combination cue and object ball are used for training purposes to improve the overall aiming skill of the player. The object ball and the cue ball are placed on the playing surface at a desired position to simulate a given billiard shot. For example, the object may be placed near a corner pocket. Using the method of the present invention, as described herein, the object ball, relative to the desired aiming line, falls on a given sight line on the playing surface. This sight line determines the angle of the shot to be played and indicates which indicia are to be used on the object ball and the cue ball to impact the object ball to ensure that it is directed on the desired aiming line.

Accordingly, it is a primary object of the instant invention to provide an object ball and cue ball aiming system to improve a player's aiming in the game of billiards and pocket pool.

Another object of the instant invention is to provide a method for using the object ball and aiming system.

Still further, an object of the instant invention is to provide system and method that greatly simplifies the aiming of billiard balls on a playing surface.

It is yet another object of the present invention to provide a system and method of aiming billiard balls for training.

A further object of the present invention is to provide a system and method of aiming billiard balls that is greatly improved over known prior art systems and methods.

BRIEF DESCRIPTION OF DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION

Figure 1:
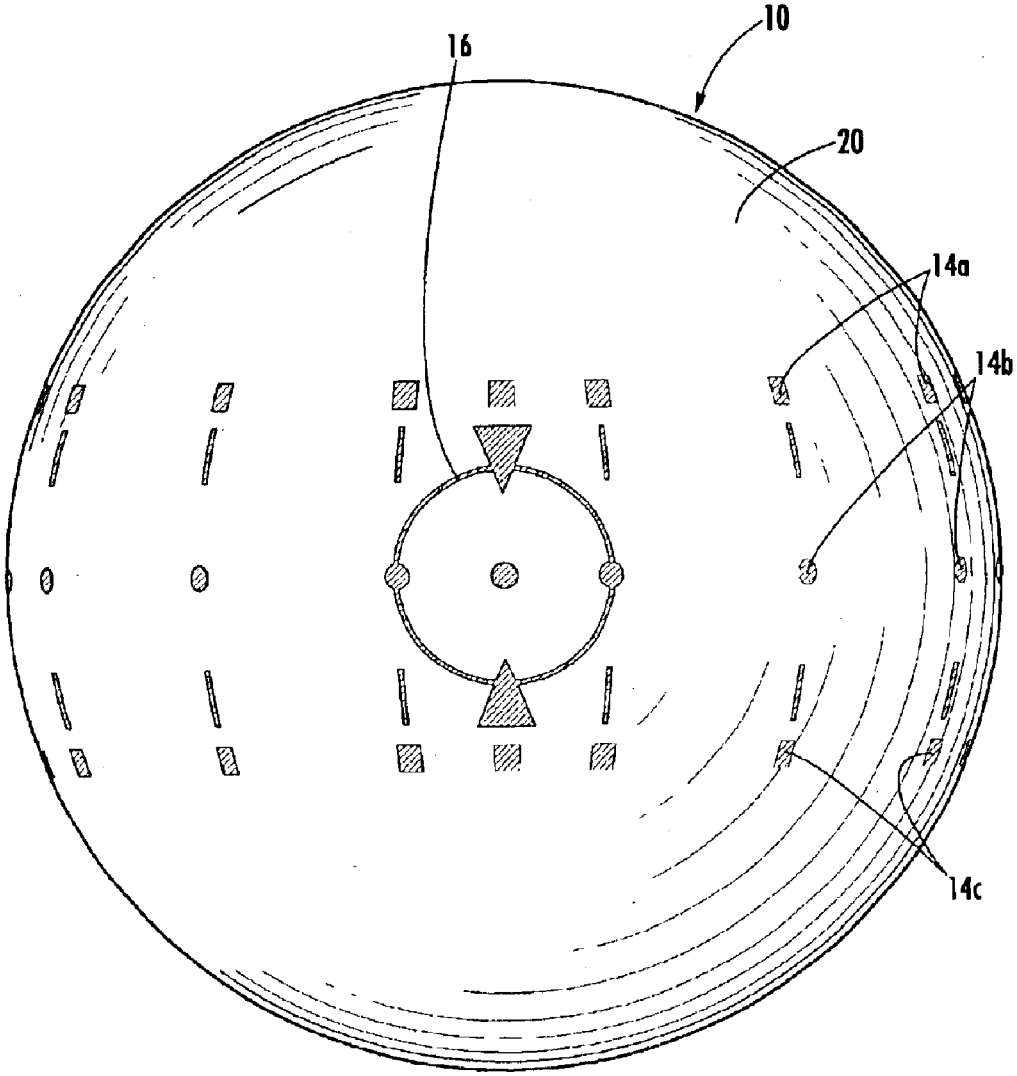
FIG. 1 is a front elevational view of a cue ball in accordance with the aiming system and method of the present invention showing a series of cue aiming line indicia thereon.

The present invention includes a unique cue ball 10 and object ball 12 that work together using a novel method to assist in learning the skill of aiming a billiard balls. Referring first to FIG. 1, a front elevational view of the front side 20 of cue ball 10 of the present invention is shown to include a number of indicia 14 on the outer surface thereof. In particular, FIG. 1 illustrates the cue aiming line indicia, generally referred to as 14, on the front side of the cue ball, i.e. the side of the cue ball that is struck by a cue stick (not shown). The cue aiming line indicia 14 is also shown in a splayed open fashion in FIG. 2 so all of the cue aiming line indicia 14 can be seen.

Figure 2:
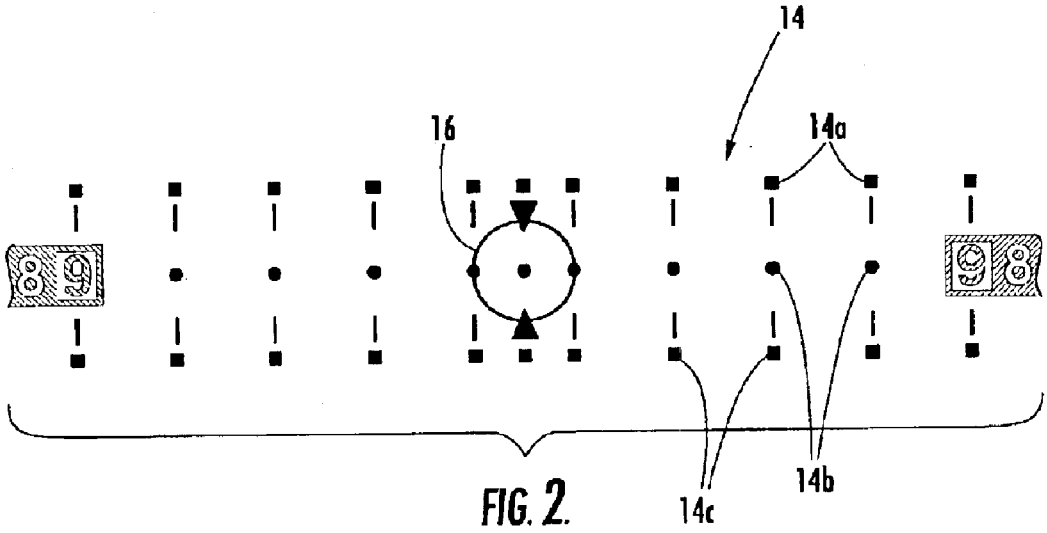
FIG. 2 is a splayed open representation of the cue aiming line indicia shown in FIG. 1.

Referring both to FIGS. 1 and 2, the cue arming line indicia 14 includes a middle series 14*b* of cue aiming line locations on the equator of and approximately 180 degree about the cue ball. As will be described in detail below, a given cue aiming line location corresponds to an impact aiming line 37 that passes through the cue ball 10. An upper series 14*a* of cue aiming line above the middle series 14*b* and a lower series 14*c* of cue aiming lines below the middle series 14*b* are also provided. A central ring 16 is also provided which corresponds to a direction of the cue ball 10 along a longitudinal rail 18 of a billiard table, as shown in FIGS. 7–12. Details of the series of cue aiming line indicia 14 will be discussed below in connection with the impact locations between the cue bail 10 and the object ball 12.

Figure 3:
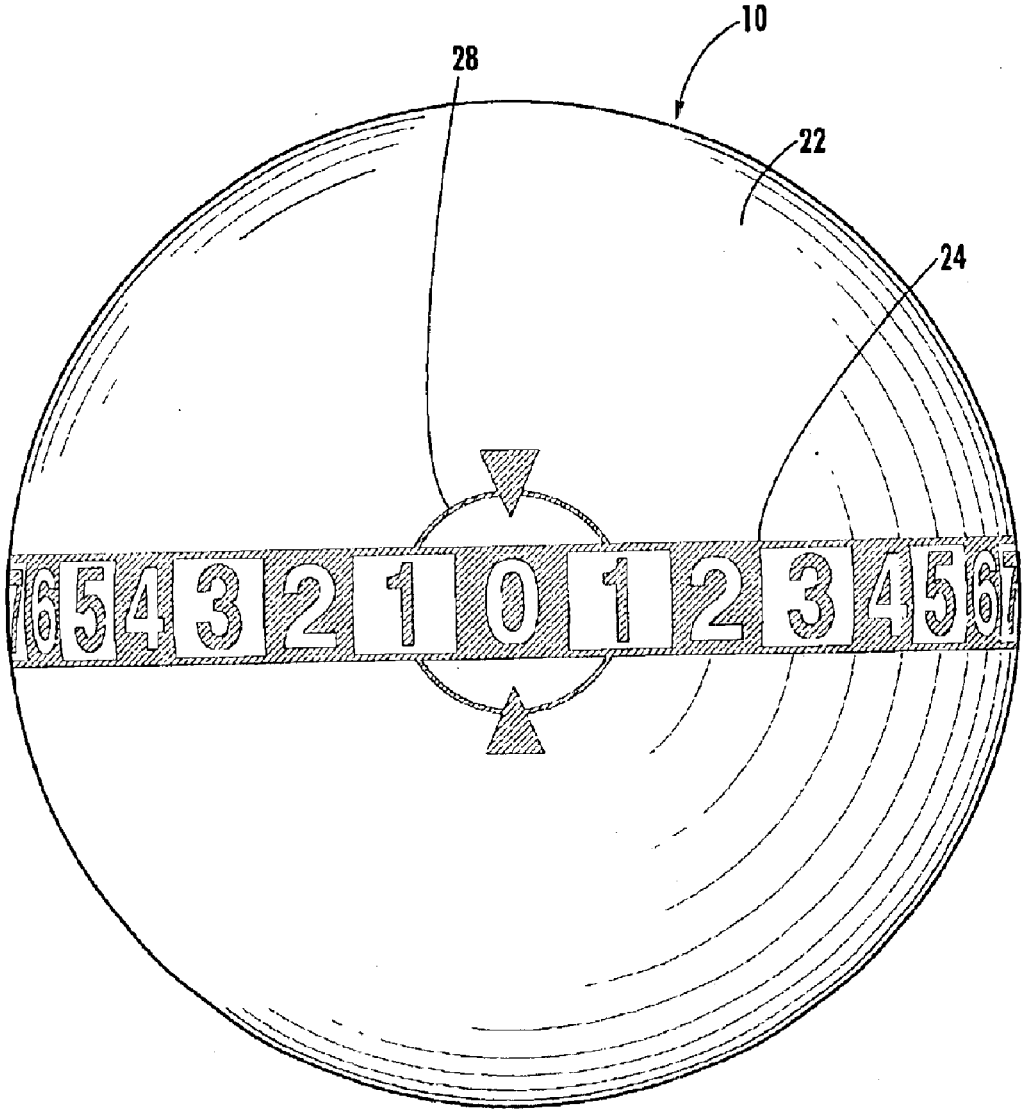
FIG. 3 is a rear elevational view of a cue ball in accordance with the aiming system and method of the present invention showing a series of cue indicia thereon.
Figure 4:
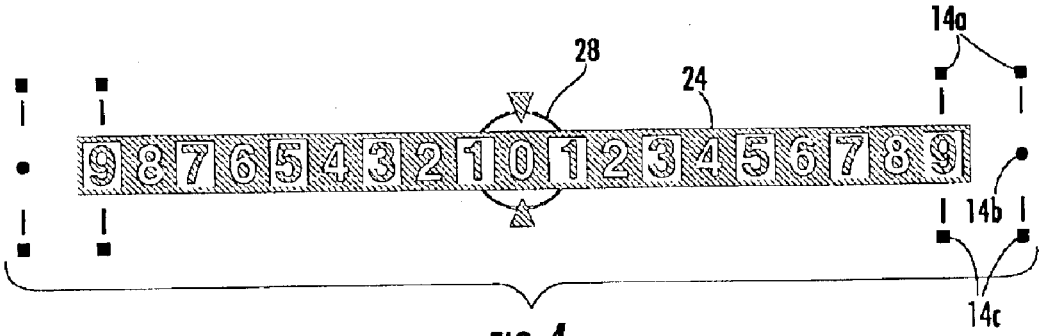
FIG. 4 is a splayed open representation of the cue indicia shown in FIG. 3.

Turning now to FIG. 3, the rear side 22 of the cue ball is shown to include a series of cue ball impact indicia 24. FIG. 4 shows the cue ball impact indicia 24 in a splayed open manner so all of the indicia 24 can be seen. This rear side 22, which carries the cue ball impact indicia 24, is a side which is opposite to the front side 20 of the cue ball 10 which carries the cue aiming line indicia 14 of FIGS. 1 and 2. The cue ball impact indicia 24 includes an array of unique indicia which extends 180 degrees about the cue ball 10 on its equator on a portion of the cue ball 10 where the cue aiming line indicia 14 is not located. As seen in FIGS. 2 and 4, the cue aiming line indicia 14 and the cue ball impact indicia 24 preferably overlap at indicia 9 on both sides of the cue ball 10 which is approximately 180 degrees from one another. More specifically, the cue ball impact indicia 24 are preferably numerals where the number "0" is located in the middle of the cue ball 10 and the other indicia are numbers starting with the number "1" and incrementally increasing as they move to the sides of the cue ball 10. As will be discussed below, these numerals correspond with a particular shot and its associated angle on a billiard table 26. It should be understood; however, that other indicia, such as letter or symbols, may be employed instead of the numbers "0" through "9" shown in the preferred embodiment for the cue ball impact indicia 24. A center ring 28 may also be included about the "0" indicia to provide additional visual alignment.

Figure 5:
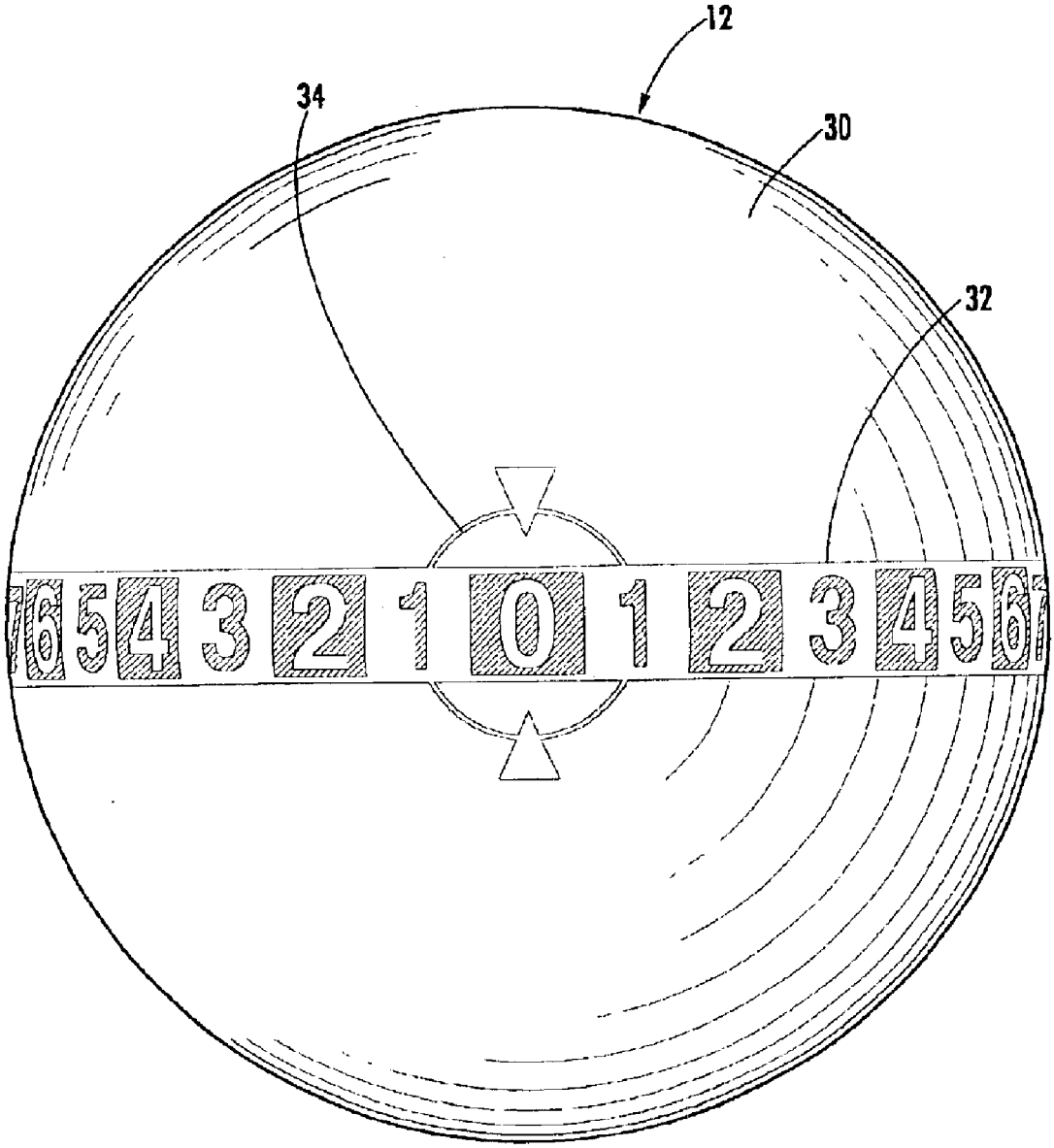
FIG. 5 is a front elevational view of an object ball in accordance with the present invention.
Figure 6:
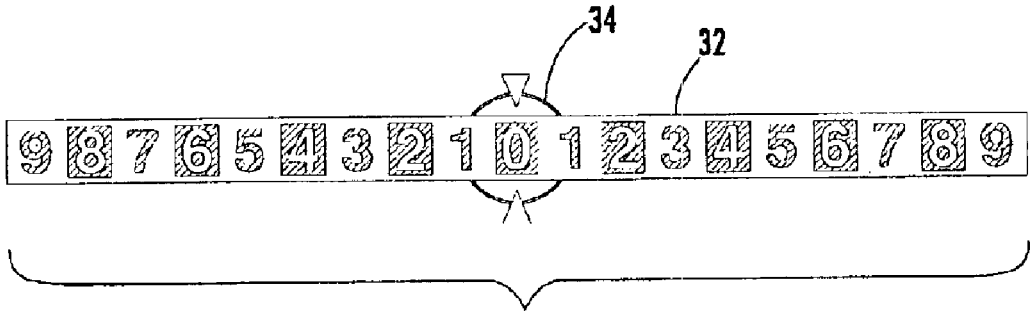
FIG. 6 is a splayed open representation of the object indicia in accordance with the present invention.

Turning now to FIGS. 5 and 6, details of the object ball 12 of the present invention are shown. FIG. 5 shows an elevational view of the object ball 12. The front face 30 of object ball 12 includes the same indicia as the rear face 22 of the cue ball 10. The front side 30 of the object ball 12 is shown to include a series of object ball impact indicia 32 and optional center ring 34 around the "0" indicia. FIG. 6 shows the object ball impact indicia 32 in a splayed open manner so all of the indicia 32 can be seen. The object ball impact indicia 32 includes an array of unique indicia which extends 180 degrees about the object ball 12 on its equator. The rear side (not shown) of the object ball 12 has no indicia thereon. In addition, the object ball impact indicia 32 are preferably numerals where the number "0" is located in the middle of the object ball 12 and the other indicia are numbers starting with the number "1" and incrementally increasing as they move to the sides of the object ball 12. As will be discussed below, these numerals correspond with a particular shot and its associated angle on a billiard table 26. It should be understood; however, that other indicia, such as letter or symbols, may be employed instead of the numbers "0" through "9" shown in the preferred embodiment.

Figure 7:
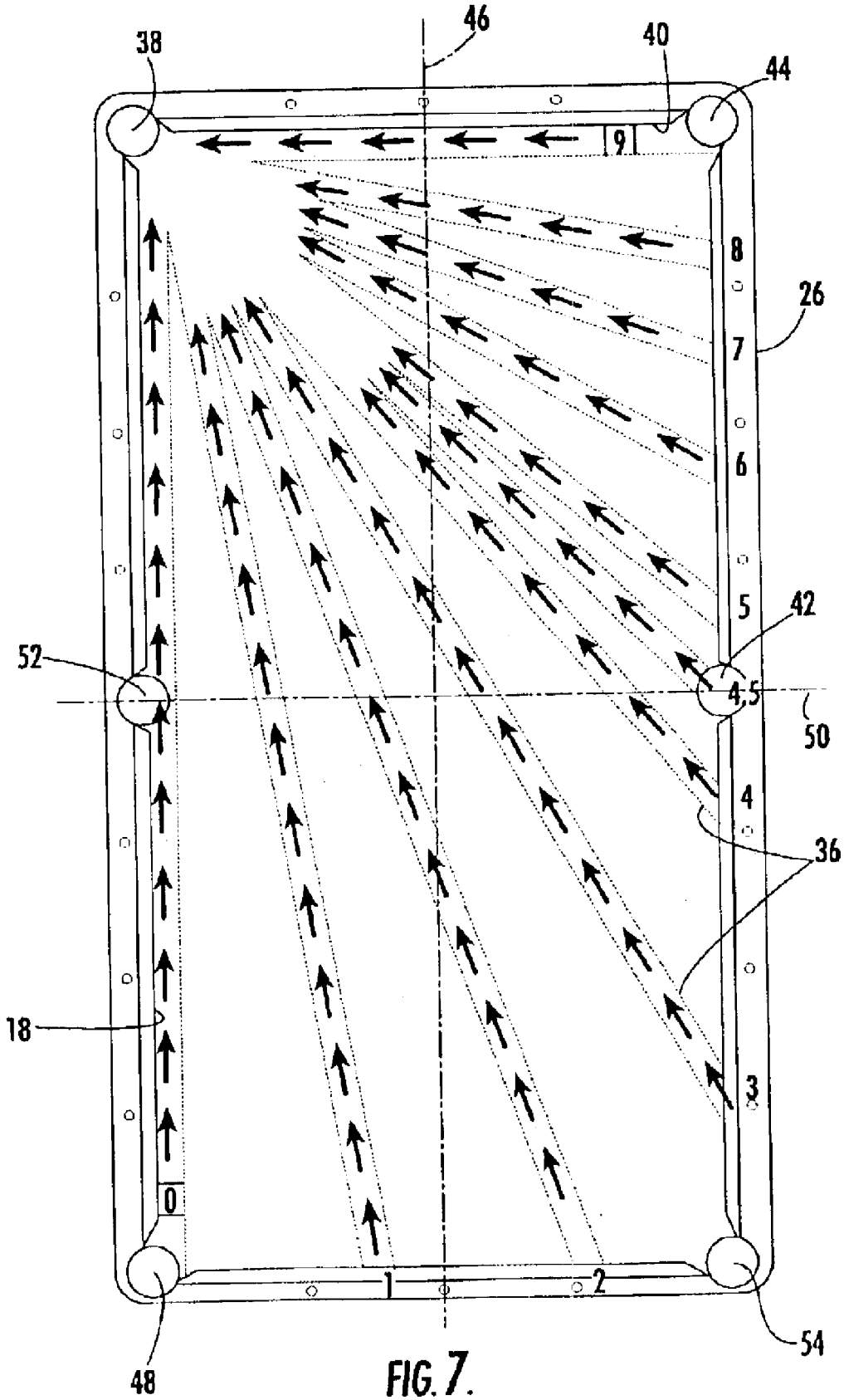
FIG. 7 is a plan view of the aiming lines for a corner pocket shot in accordance with the method of the present invention.
Figure 8:
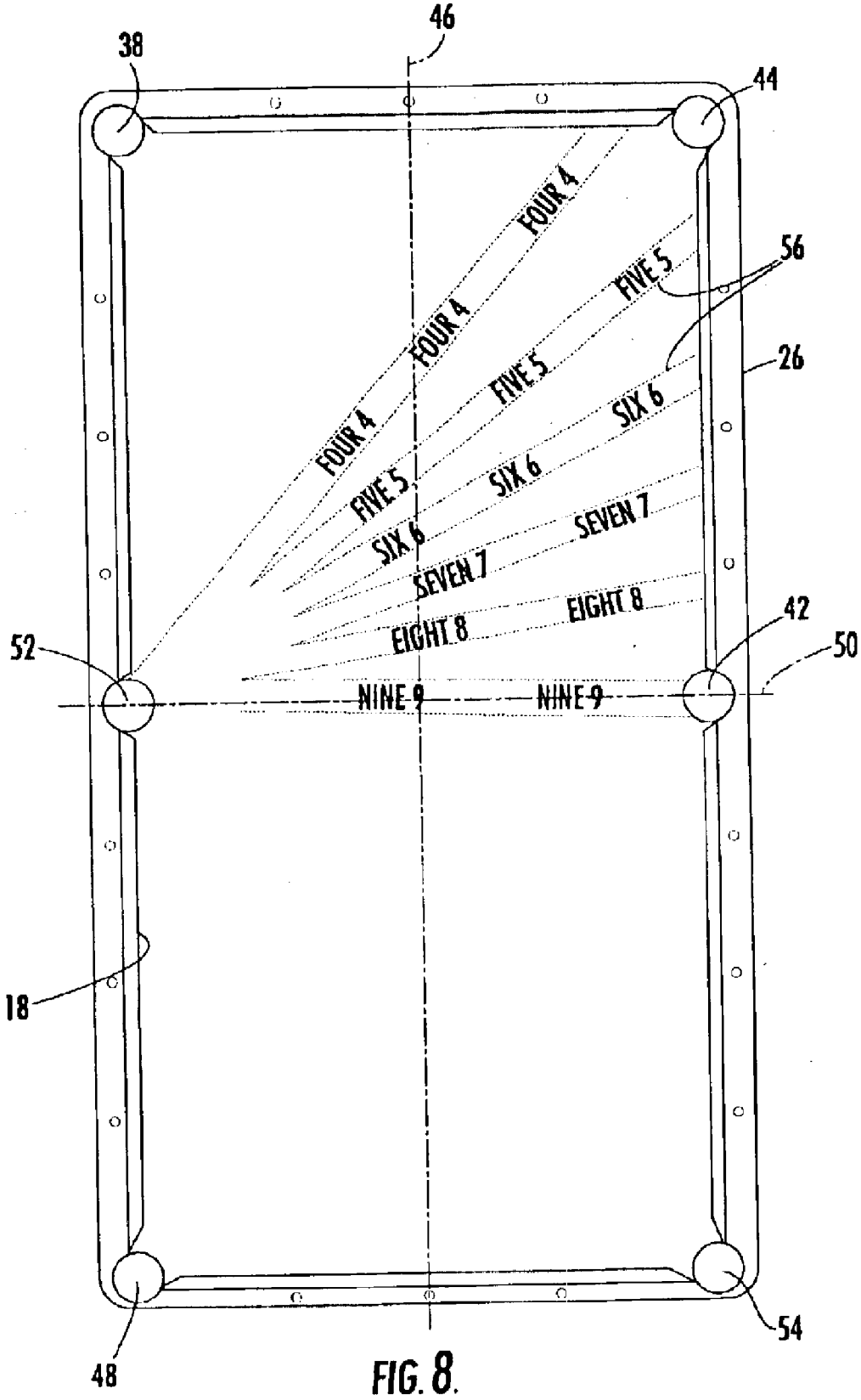
FIG. 8 is a plan view of the aiming lines for a side pocket shot in accordance with the method of the present invention.

FIGS. 7–12 illustrate how to use the cue ball 10 and object ball 12 of FIGS. 1–6 in accordance with the method of aiming of the present invention. FIGS. 7 and 8 provide a breakdown of all possible billiard shots into a total number of 15 different and unique shots, 9 for a corner pocket shot and 6 for a side pocket shot. Other possible shots are mirror images of the basic 15 shots.

Turning specifically to FIG. 7, a plan view of a billiard table 26 is shown with a number of aiming lines 36 for a shot to a corner pocket 38. To simplify the execution of shots in accordance with the present invention, all possible shots into a corner pocket can be generally broken down into a total of 11 different shots as represented by the arrowed aiming lines 36 pointing toward the target corner pocket 38. These lines 36 are not actually marked on a billiard table 26 but are merely representations of the possible aiming lines in accordance with the present invention.

The aiming lines 36 are labeled at their starting point from "0" to "9" where a "0" is along the longitudinal rail 18 and the "9" is along the horizontal short rail 40. The aiming lines marked "1" through "8" are equally spread between the "0" and "9" aiming lines, each with their respective termination points being at the target corner pocket 38. For added convenience, an optional tenth aiming line "4.5" may be visualized by the player which represents the aiming line that extends from the opposing side pocket 42 to the target corner pocket 38. The aiming lines "0" through "9" correspond to the cue ball impact indicia 24 on the cue ball 10 and the object ball impact indicia 32 on the object ball 12. The interaction of the aiming lines 36 and the cue ball impact indicia 24 and the object ball impact indicia 32 is discussed in connection with FIGS. 9–12.

In FIG. 7, the aiming lines 36 are associated with the upper left corner pocket 38 as the target pocket. If the target pocket is the upper right corner pocket 44, the entire aiming line array 36 will simply be a mirror image of the aiming line array of FIG. 7 about a longitudinal center line 46 through the table 26. Similarly, if the target pocket is the lower left corner pocket 48, the entire aiming array 36 for that pocket 48 will be a mirror image of the aiming line array 36 of FIG. 7 about a horizontal line 50 running through the middle of the table 26, namely through the two side pockets 52 and 42. Finally, if the target pocket is the lower right corner pocket 54, the entire aiming array 36 for that pocket will be a mirror image of the aiming line array 36 of FIG. 7 about a horizontal line 50 running through the middle of the table 26, namely through the two side pockets 52, 42 and about the longitudinal center line 46 through the center of the table 26.

In FIG. 8, a plan view of a billiard table 26 is shown with a number of aiming lines 56 for a shot to side pocket 52. To simplify the execution of shots in accordance with the present invention, all possible shots into a side pocket can be generally broken down into a total of 6 different shots as represented by the arrowed aiming lines 56 pointing toward the target left side pocket 52. These lines 56 are not actually marked on a billiard table but are merely representations of the possible aiming lines in accordance with the present invention.

The aiming lines 56 are labeled at their starting point from "4" to "9" where a "4" represents the most angled shot from above the pocket that can be made into the left side pocket 52 and the "9" represents an aiming line horizontally across the table. The aiming lines marked "5" through "8" are equally spread between the "4" and "9" aiming lines, each with their respective termination points being at the target side pocket 52. The aiming lines "4" through "9" correspond to the cue ball impact indicia 24 on the cue ball 10 and the object ball impact indicia 32 on the object ball 12. The interaction of the aiming lines 56 and the cue ball impact indicia 24 and the object ball impact indicia 32 is discussed in connection with FIGS. 9–12.

In FIG. 8, the aiming lines 56 are associated with the left side pocket 52 as the target pocket with the aiming lines 56 above horizontal line 50. If the target pocket is the right side pocket 42, the entire aiming line array will simply be a mirror image of the aiming line array 56 of FIG. 8 about longitudinal center line 46 through the table 26. Similarly, if the target pocket is the left side pocket 52 and the aiming lines are below the horizontal "9" line, the entire aiming array 56 for that pocket 52 will be a mirror image of the aiming line array 56 of FIG. 8 about horizontal line 50 running through the middle of the table 26, namely through the two side pockets 52 and 42. Finally, if the target pocket is the right side pocket 42 and the aiming lines are below line 50, the entire aiming array 56 for that pocket 54 will be a mirror image of the aiming line array 56 of FIG. 8 about a horizontal line 50 running through the middle of the table 26, namely through the two side pockets 52 and 42 and about the longitudinal center line 46 through the center of the table 26. Thus, the aiming lines 56 for a side pocket can be reduced to a total of 5 shots and mirror images thereof.

Figure 9:
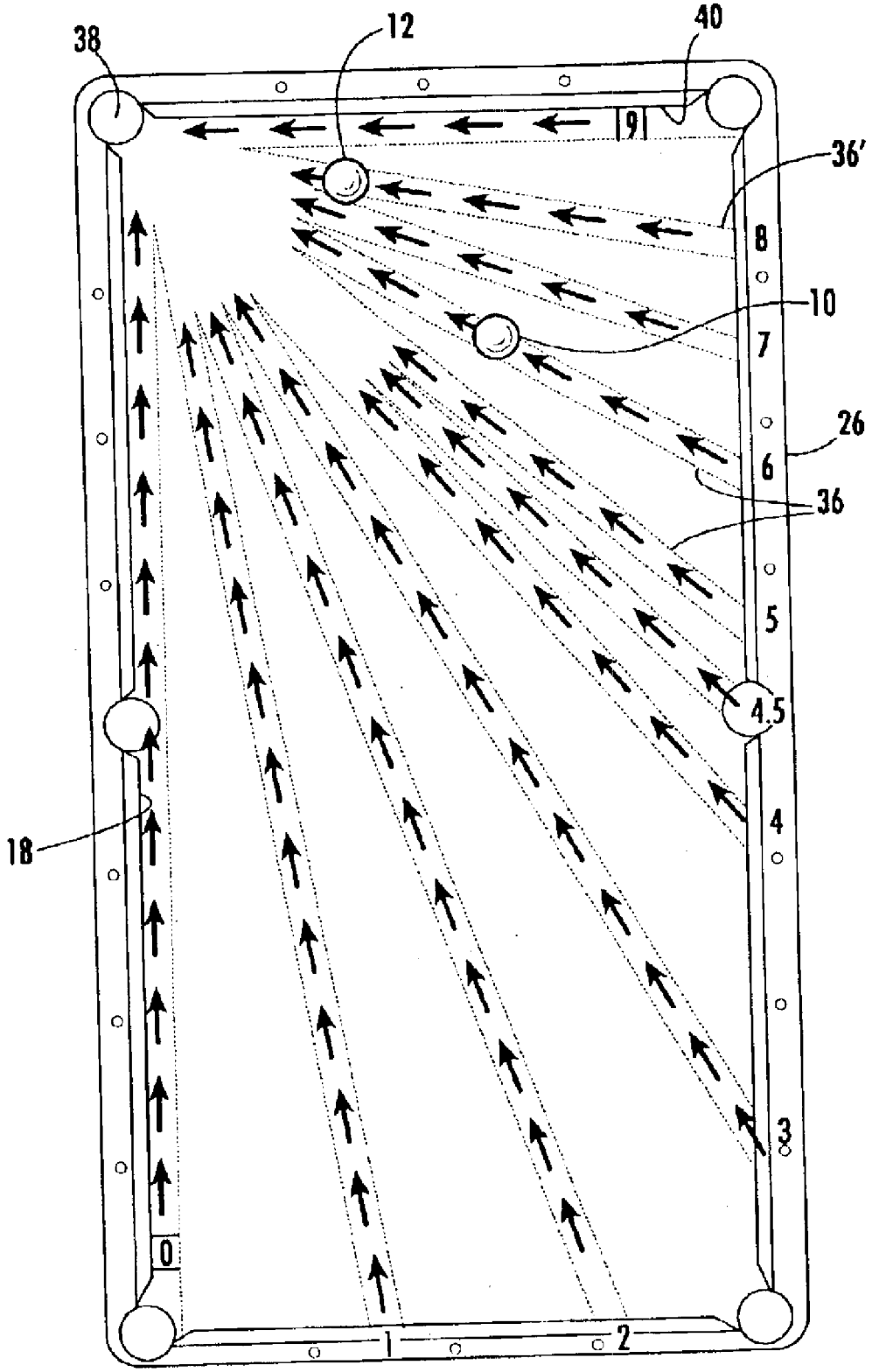
FIG. 9 is plan view of a first example of a shot using the method of the present invention.

Referring now to FIGS. 9–12 the method of the present invention is explained in detail along with the interaction of the cue ball 10, object ball 12 and aiming lines 36, 56 thereto. FIG. 9 illustrates a sample shot using the billiard balls 10,12 and method of aiming of the present invention. The billiard balls 10, 12 of the present invention are used during training and practice. In the event a player wishes to practice a given shot, the object ball 12 and the cue ball 10 of the present invention are placed on the billiard table 26 in the desired location. Or, for example, during actual gameplay, the standard cue ball and standard object ball can be temporarily replaced with the cue ball 10 and object ball 12 of the present invention for training.

FIG. 9 illustrates an example of shot into corner pocket 38. The object ball 12 is positioned proximal to the upper rail 40 while the cue ball 10 is positioned in the middle of the upper half of the billiard table 26. As can be understood due to the relative locations of the cue ball 10, the object ball 12 and the target corner pocket 38, an angled impact must be made onto the object ball 12 with the cue ball 10 in order to sink it into the upper left corner pocket 38. In other words, a straight impact of the cue ball 10 into the object ball 12 will not sink the object ball 12 in the corner pocket 38.

Figure 10:
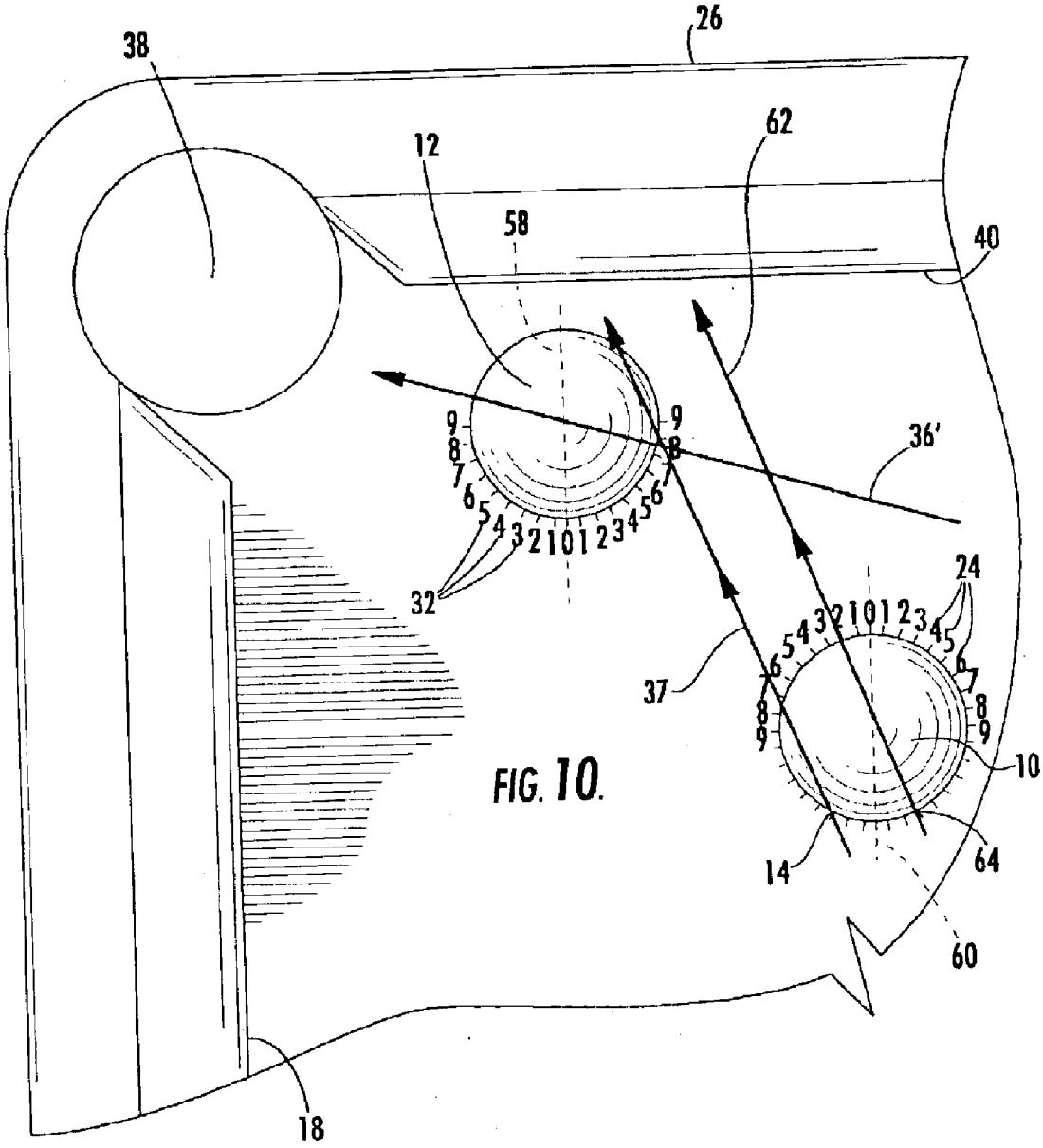
FIG. 10 is a close-up view of FIG. 9.

Therefore, the appropriate angle of impact must be selected by the player and then executed. The method and billiard balls 10, 12 of the present invention assists and trains the player to identify the correct shot and angle of impact and then execute it. In that connection, the appropriate aiming line 36' of impact is selected. FIG. 10 shows a close-up plan view of the corner pocket shot example shown in FIG. 9. The object ball 12 is oriented so that its object ball impact indicia 32 is in a plane substantially parallel to the playing surface of the billiard table 26 and facing in a first direction so that a line 58 running through the center of the object ball 12 the "0" indicia on the object indicia is parallel with the longitudinal rail 18. In this top plan view, the object ball impact indicia 32 and cue ball impact indicia 24 cannot be seen. However, for illustrative purposes, the indicia 32, 24 are representationally marked about the respective peripheries of the object ball 12 and cue ball 10. The cue ball 10 is also oriented so that the cue ball impact indicia 24 is in a plane substantially parallel to the playing surface of the billiard table 26 and facing in a second direction so that a line 60 running through the center of the cue ball 10 and the "0" indicia on the cue ball 10 is parallel with the longitudinal rail 18. Thus, the object ball impact indicia 32 face the cue ball impact indicia 24.

In FIG. 10, the aiming line 36' is selected so it goes through the center of the object ball and toward the target pocket 38. The object ball impact indicia 32 through which the selected aiming line 36' passes determines which numbered aiming line will be used. In the example of FIG. 10, the aiming line 36' passes closest to the number "8" and will be dictated by the angles associated therewith. Thus, the object ball impact indicia 32 of "8" will be selected with impact aiming line 37 determined. Accordingly, the same indicia 24 numbered "8" closest to the object ball 12 will be selected as the cue ball impact indicia 24. If the impact aiming line 37 is further following through the cue ball 10, of the cue aiming line indicia 14 can also be determined to further provide additional aiming assistance for the player. Thus, the impact location "8" on the cue ball with the impact location "8" on the object ball along with the selection of a cue aiming line indicia 14 assists the player in aiming and executing the shot.

In accordance with the method of the present invention, impact of an object ball impact indicia 32 with the same numbered cue ball impact indicia 24 that is closest to the object ball 12 will result in the object ball 12 being directed along the previously selected aiming line 36', namely, into the upper left corner pocket 38. In the example of FIG. 10, the player must strike the cue ball 10 along a cue ball path 62 with the intention of the object ball impact indicia 32 numbered "8" to impact the cue ball impact indicia 24 numbered "8" (which is closest to the object ball 12). The appropriate portion of the cue ball 10 is struck to ensure that is travels on path 62.

Of course, once the cue ball is struck, it will roll and the cue ball impact indicia 24 will roll as well. However, at this point, whether the number "8" cue ball impact indicia 24 actually impacts the object ball impact indicia 32 numbered "8" is not important because the cue ball 10 has already been struck. What is important and what has been accomplished by the present invention is to direct the cue ball 10 into the object ball 12 using the training visualization of impacting an indicia 24 on the cue ball 10 with the same numbered indicia 32 on the object ball 12. It should also be understood that the cue ball 10 should be struck without any side spin or side English as such spin adds additional variables to a shot and will change the direction of the object ball 12.

Figure 11:
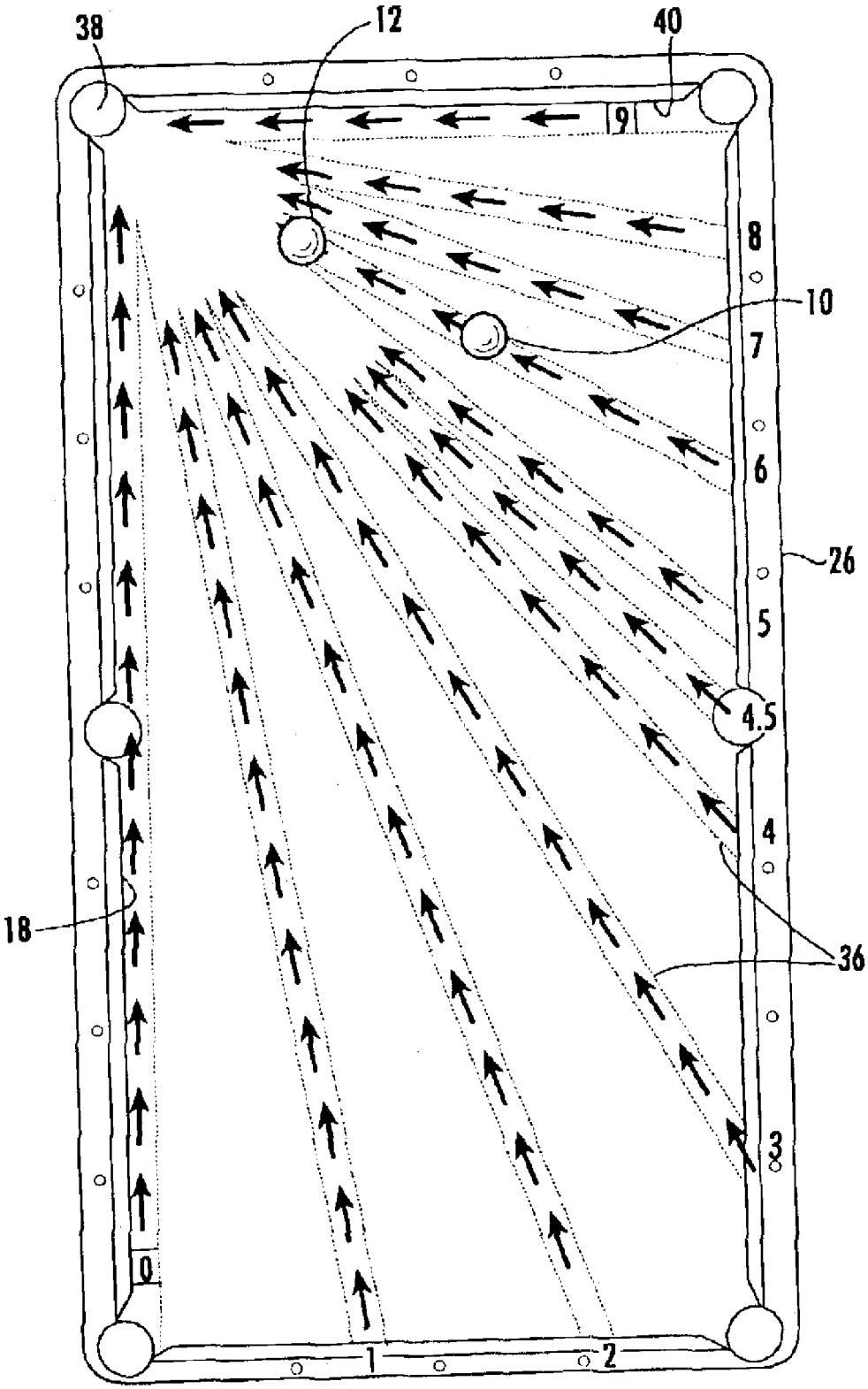
FIG. 11 is a plan view of a second example of a shot using the method of the present invention.
Figure 12:
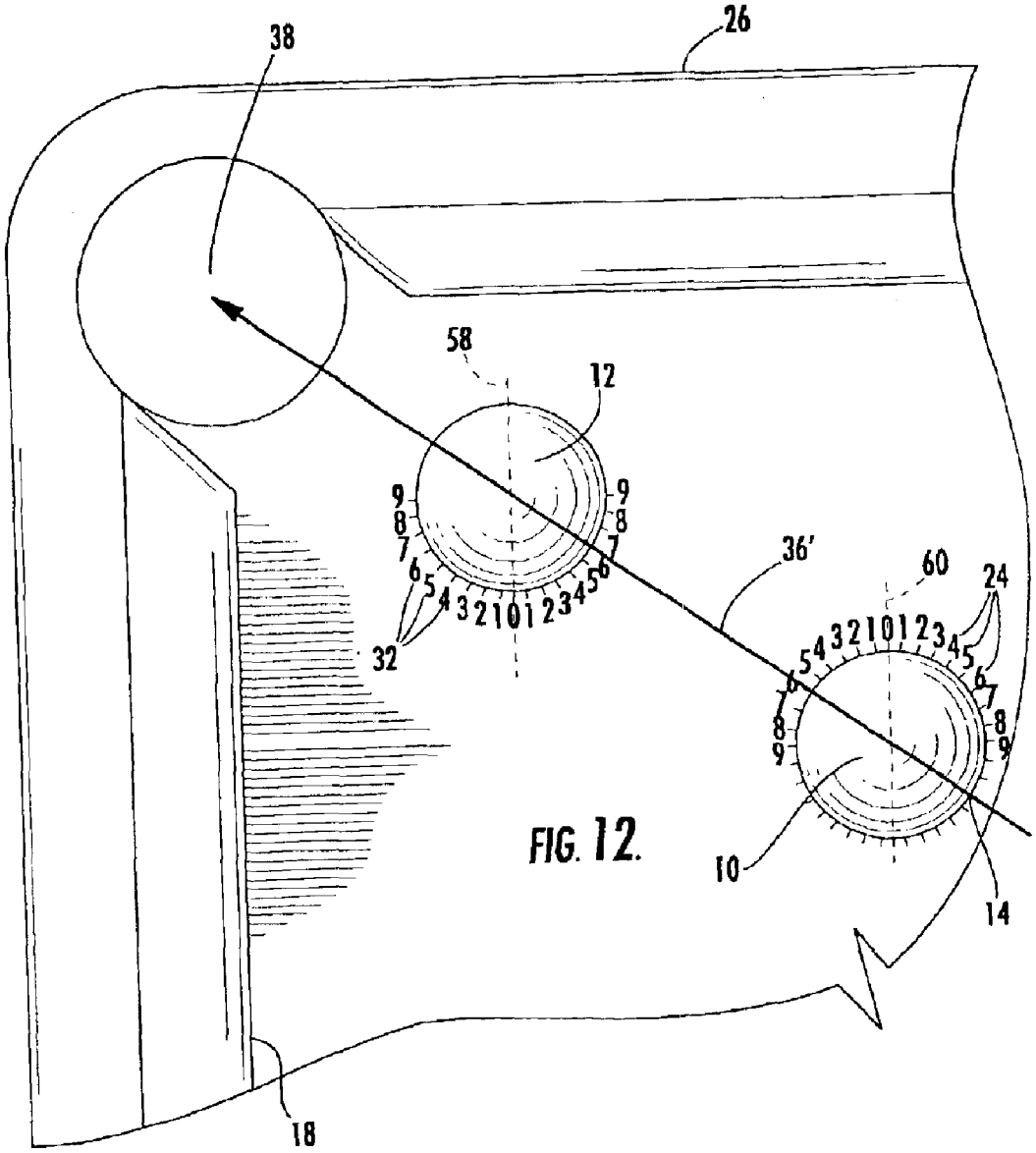
FIG. 12 is a close-up view of FIG. 11.

Another example shot is shown in FIGS. 11 and 12. In this example, a straight shot is illustrated being made into the upper left corner pocket 38. In FIG. 11, the object ball 12 falls on the number "6" aiming line. As shown in FIG. 12, with the object ball 12 properly oriented with the object ball center line 58 being parallel with the longitudinal rail 18, the aiming line 36' to sink the object ball 12 in the upper left corner pocket 38 passes through the number "6" indicia on the object ball 12. Thus, to sink the object ball 12 on the number "6" aiming line, the cue ball 10 must impact the object ball 12 so that the number "6" impact indicia 24 of the cue ball impacts into the number "6" impact indicia 32 of the object ball 12. In this case, the relative positioning of the upper left corner pocket 38, the object ball 12 and the cue ball 10, a straight shot is executed to sink the object ball 12.

With the concepts illustrated in the examples of FIGS. 9–12, any other shots on the billiard table 26 can be made employing the present invention. For example, a side pocket shot is similarly executed but with the aiming lines 56 illustrated in FIG. 8. Bank shots and combinations can also be learned and executed using the present invention by shifting the target line off a pocket and onto a desired cushion or other object ball.

The object ball 12 and the cue ball 10 of the present invention are manufactured using standard billiard ball manufacturing techniques. The indicia 24, 32 may be affixed using common billiard ball printing methods, including sublimation dye printing and screen printing. Also, a training billiard table may be marked, with chalk or the like, to further assist the player in determining the appropriate aiming lines 36, 56. Further, reference cards depicting the corner pocket aiming lines 36 of FIG. 7 and the side pocket aiming lines 56 of FIG. 8 can be provided so that a player learning the method of the present invention can quickly determine and select the aiming lines even during a normal competitive game.

Once all of the aiming lines are learned, the player can quickly determine the aiming line required to direct the object ball 12 as desired and impact the corresponding object ball impact point with the cue ball impact point even with standard billiard balls that do not have the impact indicia 24, 32 described herein. Thus, the cue ball 10 and object ball 12 are used with the present method to train a player so they may learn how to properly select and then execute a billiard shot with success and then repeat it consistently during actual game play.

It would be appreciated by those skilled in the art that various changes and modifications can be made to the illustrated embodiments without departing from the spirit of the present invention. All such modifications and changes are intended to be covered by the appended claims.

What is claimed is:

1. A method of aiming a cue ball to impact an object ball for motion of the object ball in a desired direction, comprising the steps of:

providing an object ball having an outer surface with an object equator and a center;

providing a series of object indicia on the outer surface of the object ball proximal to the object equator; the object indicia including a center indicia and a number of auxiliary indicia on opposing sides thereof;

providing a cue ball having an outer surface with a cue equator and a center;

providing a series of cue indicia on the outer surface of the cue ball proximal to the cue equator; the cue indicia including a center indicia and a number of auxiliary indicia on opposing sides thereof; the cue indicia being substantially identical to the object indicia;

providing a billiard table with a rail and a playing surface;

aligning the object ball so that the object indicia thereon is in a plane substantially parallel to the playing surface and facing in a first direction so that a line running through the center of the object ball and the center indicia on the object indicia is parallel with the rail;

aligning the cue ball so that the cue indicia thereon is in a plane substantially parallel to the playing surface and facing in a second direction so that a line running through the center of the cue ball and the center indicia on the cue ball is parallel with the rail; the second direction and the first direction facing one another;

determining an aiming line for the desired direction of travel of the object ball;

extending the aiming line through the object ball and through the object indicia;

determining which of the object indicia the aiming line run through to identify an object ball target indicia;

selecting a corresponding cue indicia to the object ball target indicia to identify a cue ball impact indicia;

aiming the cue ball to contact the object ball so that the identified cue ball impact indicia on the cue ball contacts the identified object ball target indicia on the object ball;

impacting the cue ball into the object ball; and directing the object ball along the aiming line.

2. The method of claim 1, further comprising the steps of:

providing a series of cue aiming line indicia on the cue ball and on an opposing side of the cue ball to the cue indicia.

3. The method of claim 1, wherein the center indicia of the object ball is numbered "0" and the auxiliary indicia on the object ball are numbers starting at "1" and incrementally increasing as they extend away from the center indicia of the object ball.

4. The method of claim 1, wherein the center indicia of the cue ball is numbered "0" and the auxiliary indicia on the cue ball are numbers starting at "1" and incrementally increasing as they extend away from the center indicia of the cue ball.

5. A combination of a cue ball and an object ball for use in playing pool or billiards, comprising:

an object ball having a generally spherical outer surface with an object equator and a center; a series of object indicia on the outer surface of the object ball proximal to the object equator; the object indicia including a center indicia and a number of auxiliary indicia on opposing sides thereof; and a cue ball having a generally spherical outer surface with a cue equator and a center; a series of cue indicia on the outer surface of the cue ball proximal to the cue equator; the cue indicia including a center indicia and a number of auxiliary indicia on opposing sides thereof; the cue indicia being substantially identical to the object indicia;

whereby impact of a selected one of the object indicia with a corresponding one of the cue indicia causes the object ball to travel along an aiming path through the center of the object ball and the selected one of the object indicia.

6. The combination of claim 5, further comprising:

a series of cue aiming line indicia on the cue ball and on an opposing side of the cue ball to the cue indicia.

7. The combination of claim 5, wherein the center indicia of the object ball is numbered "0" and the auxiliary indicia on the object ball are numbers starting at "1" and incrementally increasing as they extend away from the center indicia of the object ball.

8. The combination of claim 5, wherein the center indicia of the cue ball is numbered "0" and the auxiliary indicia on the cue ball are numbers starting at "1" and incrementally increasing as they extend away from the center indicia of the cue ball.

* * * * *